United States Patent [19]

Robinson

[11] 4,189,855

[45] Feb. 26, 1980

[54] ELECTRIC PRESSING IRON HAVING INDICATING READY LIGHT

[75] Inventor: George W. Robinson, Cheshire, Conn.

[73] Assignee: Scovill Manufacturing Company, Waterbury, Conn.

[21] Appl. No.: 917,184

[22] Filed: Jun. 20, 1978

Related U.S. Application Data

[63] Continuation of Ser. No. 810,502, Jun. 27, 1977, abandoned.

[51] Int. Cl.[2] ..... D06F 75/02; D06F 75/26; H05B 1/02

[52] U.S. Cl. ..... 38/82; 219/248; 219/506

[58] Field of Search ..... 38/82; 219/246, 248, 219/506, 515

[56] References Cited

U.S. PATENT DOCUMENTS

| | | | |
|---|---|---|---|
| 2,029,940 | 6/1933 | Eaton et al. | 219/248 X |
| 2,527,775 | 10/1950 | Sutton | 219/506 X |
| 2,593,812 | 4/1952 | Turner | 219/248 X |
| 2,778,913 | 1/1957 | Finlayson | 219/506 |
| 2,786,990 | 3/1957 | Garner | 219/506 X |
| 3,035,144 | 5/1962 | Kircher | 219/506 X |

*Primary Examiner*—Patrick D. Lawson
*Attorney, Agent, or Firm*—Dallett Hoopes

[57] ABSTRACT

Ready light circuit is provided comprising a simple third switch blade added to standard thermostat two-blade switch in electric iron. Light is activated when bimetallic element of switch drives third blade into engagement with other blade as iron reaches set temperature. Light stays illuminated as long as main contacts of standard-type blades remain open. When thermostat calls for more heat, light in circuit which is across main contacts, is shorted out.

13 Claims, 13 Drawing Figures

OFF

HEATING

ON TEMPERATURE

OVERSHOOT

COOLING

ELECTRIC PRESSING IRON HAVING INDICATING READY LIGHT

This is a Continuation of application Ser. No. 810,502, filed June 27, 1977, now abandoned.

BACKGROUND OF THE INVENTION

1. Field of the Invention

This invention relates to an electric pressing iron having a ready light for indicating when the soleplate of the iron is in the temperature range for which the temperature control has been set. More specifically, the invention relates to an electric pressing iron having an indicator light circuit including extremely simple switch means which accurately reflect the condition of the iron, are capable of simple factory adjustment, and are foolproof in operation.

2. Description of the Prior Art

The prior art includes the U.S. Pat. No. 2,778,913 which was issued Jan. 22, 1957 to F. E. Finlayson. The structure shown in this patent results in the activation of an indicator light when the temperature of the iron is in the desired temperature range. Another U.S. Pat. No. 2,566,270, discloses means in which an electric pressing iron may be provided with a signal means including a light adapted to blink when the soleplate temperature is too high or too low, and which is adapted to burn continuously when the soleplate temperature is correct.

Earlier structures have involved a multi-part switch structure often complicated and requiring many different adjustments. They have been susceptible to quickly falling out of adjustment.

SUMMARY OF THE INVENTION

The invention involves the provision of a simple three-blade switch means comprising a simple modification of a conventional iron switch. Means are provided to permit a simple one-time adjustment in the factory. More specifically, the invention provides a third contact blade disposed between the blades of the conventional two-blade switch, the third blade being adapted to engage with the upper switch blade when the iron is at the desired temperature thereby completing the circuit through an indicator lamp. The usual bimetallic temperature sensing element which drives the heater switch is also adapted to co-act with the third blade to effect the desired result.

Like some earlier units, the present unit offers the advantage that the ready light will go out when the adjustment on a hot iron is moved to a cooler temperature and relight when the temperature of the iron reaches the lower temperature. This helps the user avoid the scorching of synthetic fabrics, for instance.

BRIEF DESCRIPTION OF THE DRAWING

Other objects and features of the invention will be apparent from a reading of the following specification and reference to the attached drawings, all of which comprise a disclosure of a non-limiting embodiment of the invention. In the drawings.

DESCRIPTION OF THE PREFERRED EMBODIMENT

Figure 1:
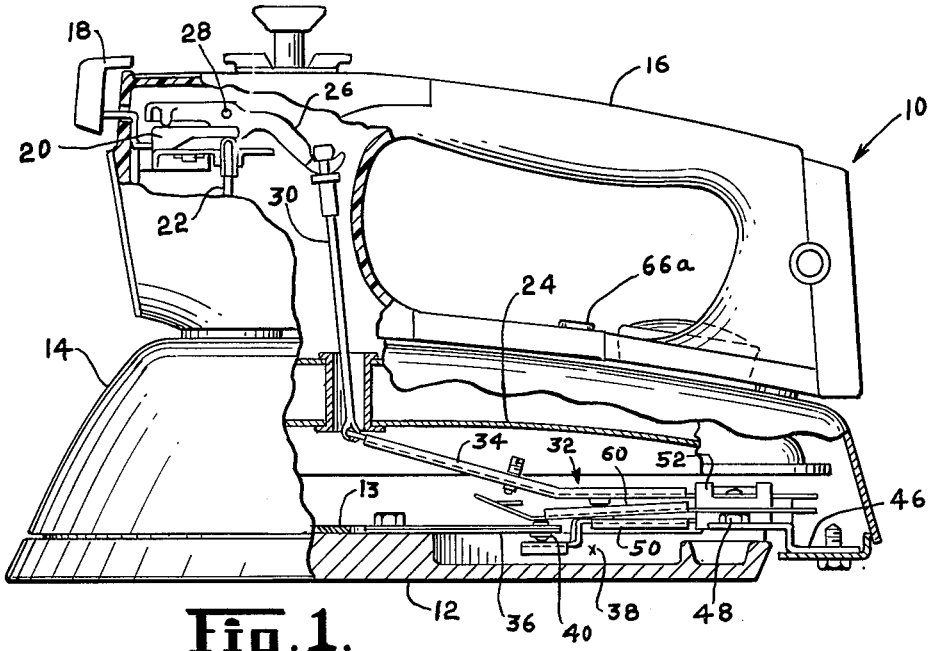
FIG. 1 is an elevational view of a pressing iron embodying the invention, the iron being broken away in parts to reveal operative parts thereof.
Figure 2:
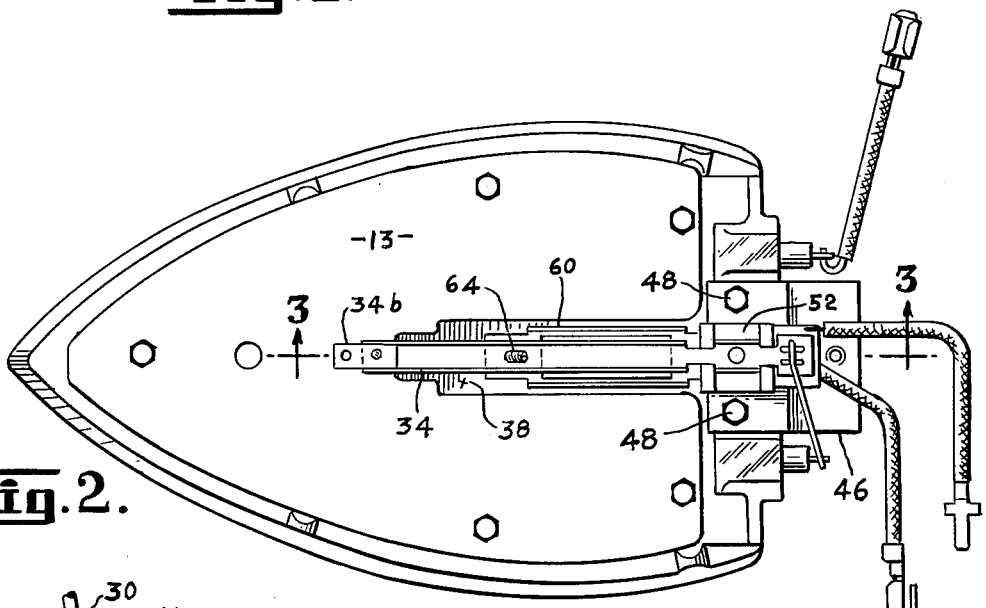
FIG. 2 is a top plan view of the soleplate having the upper portions of the iron removed.

Referring more specifically to the drawings, an iron embodying the invention is generally designated 10 in FIG. 1. Outwardly it comprises a cast soleplate 12 with cover 13 (FIG. 2) superposed by a conventional sheetmetal skirt 14 over which is mounted a handle 16, a front portion of which is hollow, as shown, to accommodate various working parts. A light window 66*a* is formed in the housing under the handle.

A temperature setting lever 18 is disposed external of the handle and is pivoted to structure inside the handle and adapted to rotate a cam 20. As is conventional, the cam operates a steam control valve 22 permitting water to be dispensed from a tank 24 onto the inside of the soleplate 12 which is perforated (not shown) for the purpose of venting steam.

Also operated by the cam 20 in a well-known manner is arm 26 pivoted at 28 and attached at its rearward end to a temperature element setting link 30.

Mounted on the top of the soleplate 12 towards the rear of the iron is a switch assembly 32 which includes a forwardly cantilevered sheetmetal upper blade 34, the distal end of which is engaged by the link 30. Thus, by manipulating the lever 18, the height of the distal end of the blade 34 may be raised or lowered and set at a desired level to effect a desired temperature setting of the iron. Blade 34 cooperates with other structure in the switch assembly 32 to effect the activation and deactivation of the iron heater to achieve the desired temperature.

Included in the conventional iron temperature control switch assembly is the bimetallic element 36 mounted at one end to the soleplate and cantilevered out over a recess 38 in the soleplate in the opposite direction from the switch blade 34. The distal end of the bimetallic element is formed with an opening penetrated by a headed element 40, the head being disposed on the underside of the element 36, the upper portion of the element comprising a stem terminating in a round dome and secured in the element 36 by a spring washer 42.

Still more specifically, the switch assembly 32 is rivetted as at 44 to a plate 46 which, as shown, is bolted at 48 (FIG. 2) to the soleplate. The assembly includes a sheetmetal lower blade 50 insulated from the rivet 44 and plate 46, and an insulation block means 52, preferably ceramic.

Figure 5:
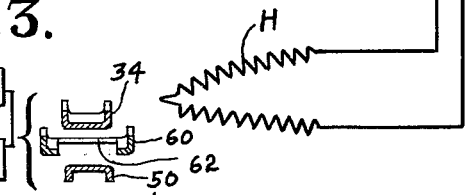
FIG. 5 is a fragmentary sectional view taken on the line 5—5 of FIG. 3.
Figure 6:
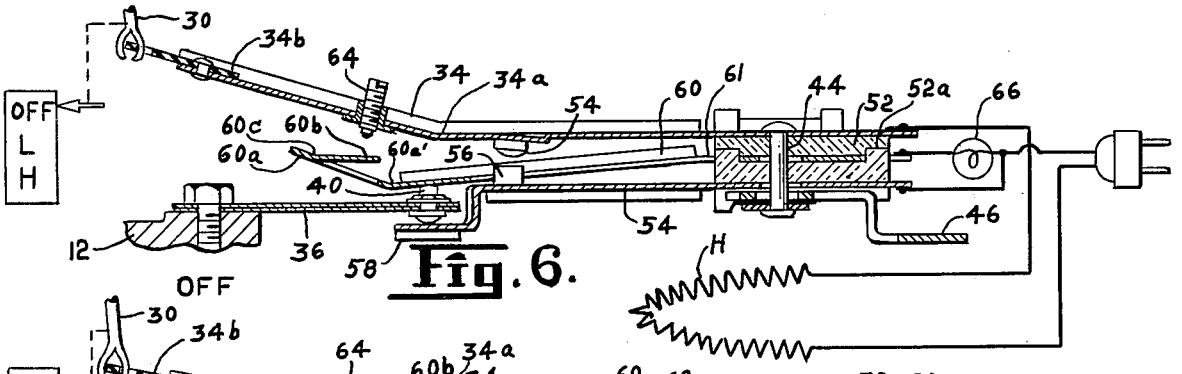
FIGS. 6 through 12 are views comparable to portions of FIG. 3 showing the position of the various elements under conditions as described in the specification herebelow.

The upper blade 34 and the lower blade 50 carry contact buttons 54 and 56, respectively. The lower blade 50 is biased upward by its natural resilience and carries a downwardly offset dog-leg portion 58. The upper surface of the offset portion 58 continuously engages the head of the element 40. As shown (FIG. 5), the blades 34 and 50 may be channel-shaped to stiffen them, the upward bias of the blade being achieved at a section 50*a* thereof immediately adjacent the block means 52. The outer end of the blade 34 may be deflected at an elbow 34*a* as shown and terminate in an insulated section 34*b* which is apertured and receives the end of the link 30.

The operation of the structure as shown before is conventional depending upon the setting of lever 18 and in turn the height of the end 34*b* of blade 34, and depending on the disposition of the bimetallic element 36, that is, whether it holds the offset portion 58 down or not, the buttons 54, 56 contact or not to activate or deactivate the circuit including the heating element H.

To this point, the iron as disclosed is conventional. A similar iron is shown in the U.S. Pat. No. 3,711,972, issued Jan. 23, 1973 to F. H. Risacher.

Figure 3:
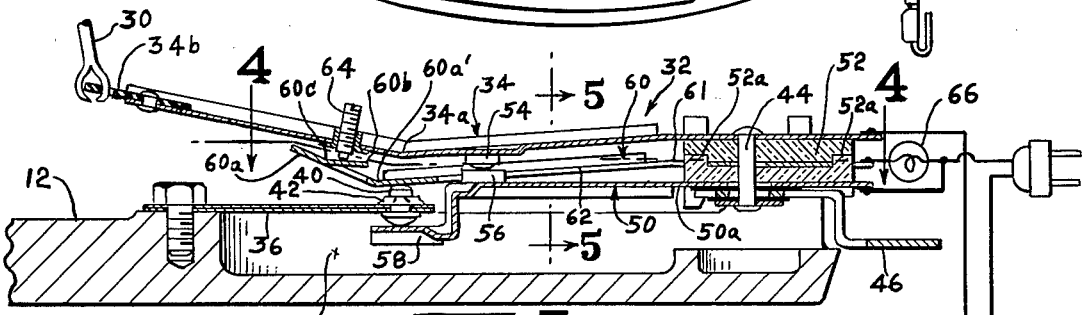
FIG. 3 is an enlarged sectional view taken on the line 3—3 of FIG. 2 and including a schematic diagram of the iron heating and indicating light circuit.
Figure 4:
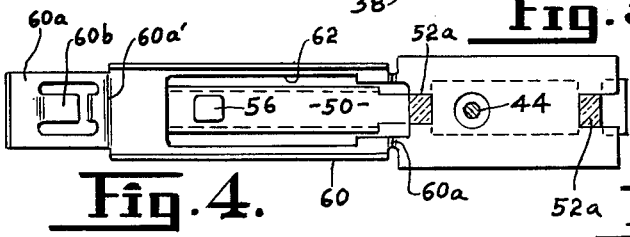
FIG. 4 is a fragmentary sectional view taken on the line 4—4 of FIG. 3.

Attention is now focused on the light circuit and components which are the essence of the present invention. The insulating block means 52 (FIG. 3) is bisected intermediate its upper and lower halves to clamp therebetween the end of a third blade 60. The blade 60 is apertured generously about the rivet 44 so as to not contact it and a terminal end extends out rightwardly, as shown. Preferably, the two parts of the block means 52 contain projections 52*a* and recesses which interfit to immobilize the switch assembly.

The third blade 60 extends leftward from the block means 52, as shown, and has a prebiased inclination downward toward its distal end due to a bent section 61 adjacent the block means 52. The distal end of the blade 60, therefore, invariably engages the dome of the element 40.

The blade 60 is also of thin sheetmetal. It presents a window 62 permitting the normal operation of the contact buttons 54 and 56 therethrough. Adjacent its distal end, the blade 60 is deflected upwardly in a terminal portion 60*a* at a line of bend 60*a'* and a tongue 60*b* is struck upward therefrom, at bend 60*c*. An adjustable set screw contact 64 is threaded into the blade 34, and its end extends downward to selectively contact the tongue 60*b*. Upon engagement of the tongue 60*b* and the contact 64, a circuit between the upper blade 34 and the third blade 60 is completed.

Figure 13:
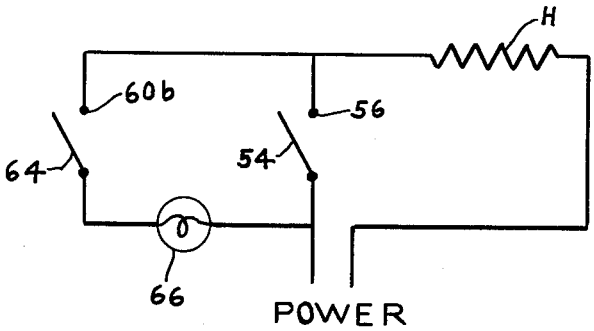
FIG. 13 is a circuit diagram.

It will be noted from the circuit diagram of FIG. 13 that the switch blades 34 and 50 (contacts 54, 56) are in series with the heater H across the power line. The light 66 is in series with the blades 60 and 34 (contacts 64, 60*b*) and across the blades 34 and 50 (contacts 54, 56). As a result, the light 66, which in the iron is disposed visibly behind the window 66*a* (FIG. 1), only lights when the contacts 64, 60*b* are closed and the heater switch 34, 50 (contacts 54, 56) is open, for when the latter is closed it shorts across the light and blades 34 and 60 (contacts 64, 60*b*). This arrangement equates to the light lighting when the iron reaches the set temperature and remaining on until the temperature drops sufficiently to cause the blades 34, 50 to close at 54, 56 activating the heater. Thus, in other words, the light is on when the soleplate is at the desired "ready" temperature.

The operation of the structure so far described will be apparent from reference to FIGS. 6 through 12. In the first place, it must be understood that the bimetallic element 36 reflects the temperature it sees and the distal end thereof is at a higher level the cooler the temperature, and at a lower level the hotter the temperature it sees.

From the drawings 6 through 12, it will be apparent that the setting of the distal end of the blade 34 which is accomplished by lever 18 through linkage 30, is highest for the "off" position and then progresses downwardly the higher the temperature for which the iron is set. For convenience, it is indicated diagrammatically in FIGS. 6 through 12 by the indications "Off", "L" for low or cooler setting, "H" for high or hot setting. With the above in mind, it will be noted that at the "off" setting, the blade 34 is high and the contact buttons 54 and 56 do not engage, the heater H not being energized. Similarly, the third blade 60, being downwardly biased, does not engage the contact 64. The lamp 66 is off.

Figure 7:
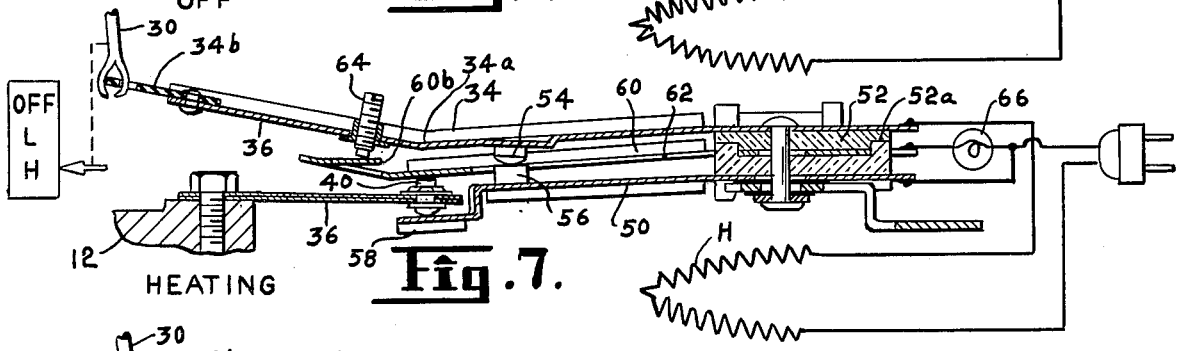
Figure 8:
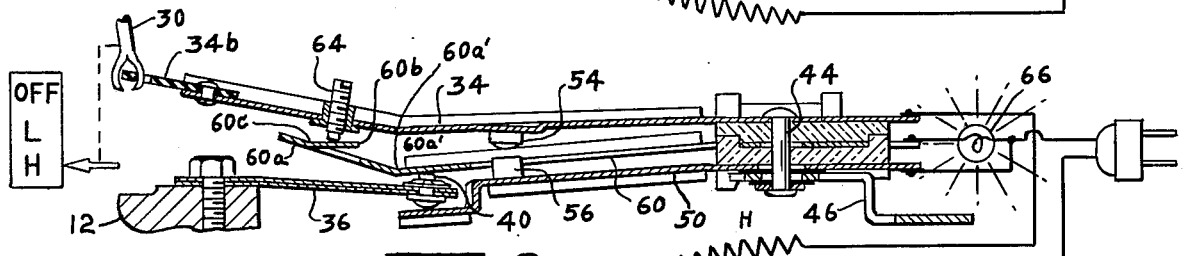

In FIG. 7, the setting has been moved to "high" which lowers the distal end of the blade 34 to the point where the buttons 54 and 56 contact, activating the heater H. While contact 64 and tongue 60*b* engage, the light does not light because the buttons 54, 56 in contact close the heater to short out the light.

As time passes and the iron heats (FIG. 8), the distal end of the bimetallic element 36 drops, driving down the blade 50 and thereby separating the contacts 54, 56. This lowering permits the blade 60 resting on element 40 also to lower, but because of the natural resilience of the blade at the deflection junctures 60*a'* and 60*c*, the tongue 60*b* still engages the contact 64. Thus, with the heater H off and contacts 64, 60*b* closed, the light 66 is activated indicating that the iron has arrived at the set temperature.

It will be understood that were the iron to initially be set from the "off" position to an "L" position, the operation would be substantially the same except that because arm 34 and button 54 would be at a slightly higher level than that shown in FIG. 7, the bimetallic element 36 would not need to lower as much for deactivation of heater H as for an "H" setting.

Figure 9:
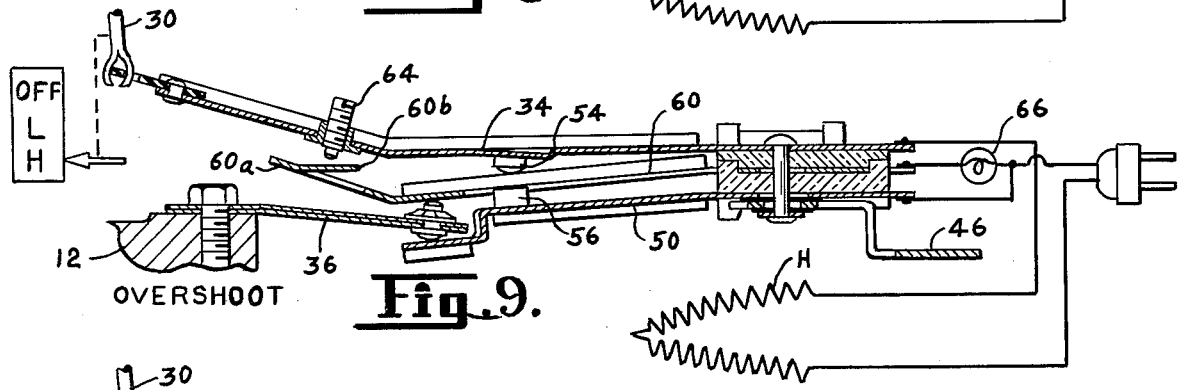

FIG. 9 depicts the "overshoot" condition in which the temperature of the soleplate continues for a short time to rise after the heater is cut off. The continued rise is due to the inertia or heat momentum of the mass of the heater and the soleplate before the ambient temperature prevails to start to cool the mass again. This phenomenon is comparable to the continued rise of a rocket for a moment after its engines have been shut off. In the overshoot condition, the bimetallic element permits the continued lowering of the arm 60 to the shown condition (FIG. 9) in which contact 64 and tongue 60*b* disengage, deactivating the light 66 to warn the user not to use the iron because its soleplate is *above* the preset temperature.

Figure 10:
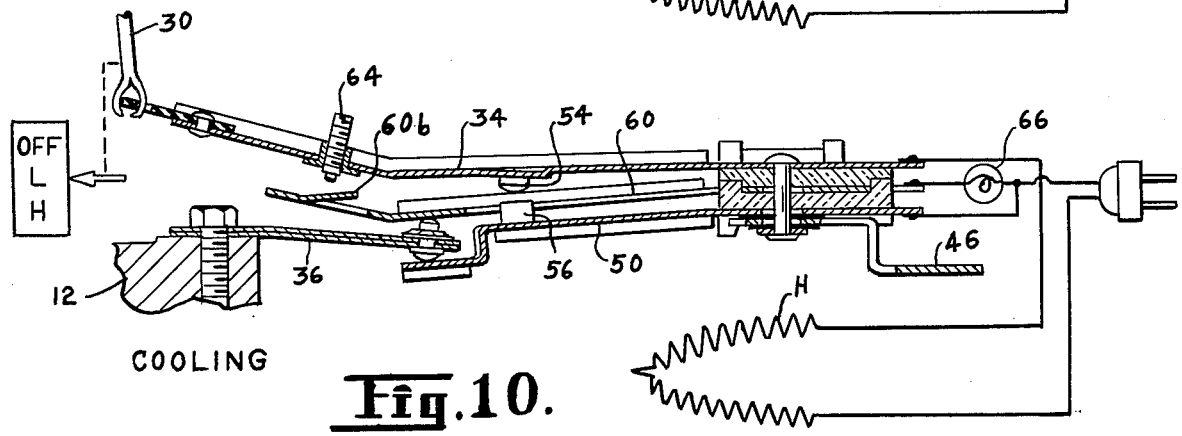
Figure 11:
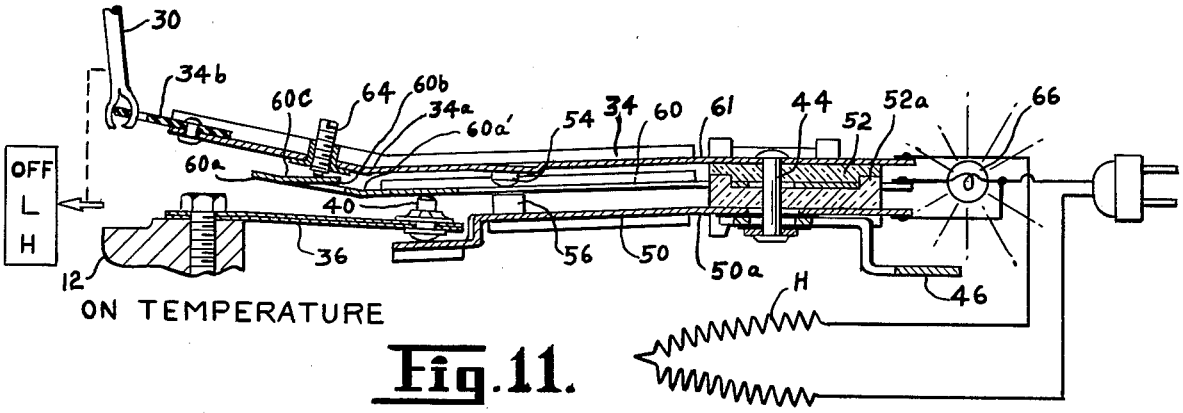
Figure 12:
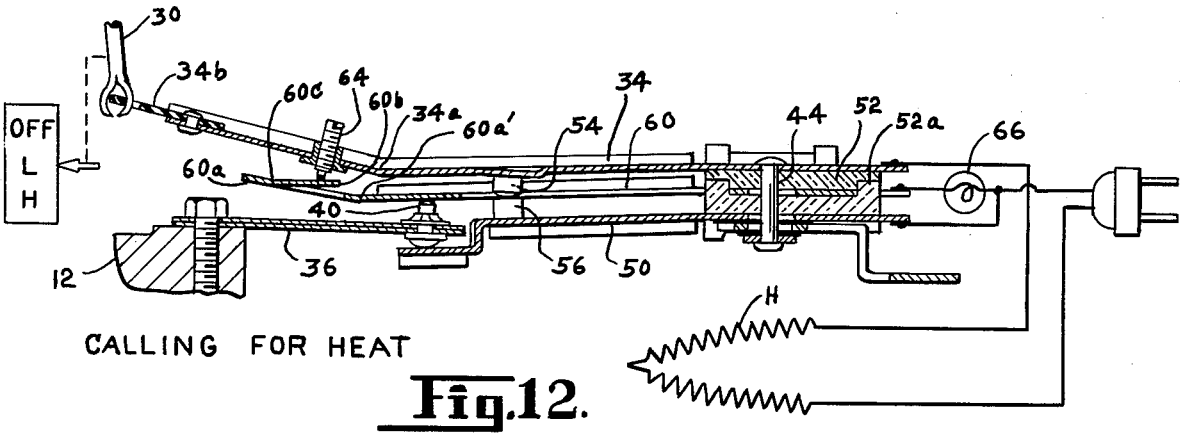

FIG. 10 depicts the condition of the parts after the temperature of the iron has been at high and the temperature setting has been changed from "high" to "low". This would be the case, for instance, if the user were to switch from ironing wools or linens to ironing synthetics. Because the bimetallic element 36 is low (FIG. 10), the blade 50 is held down and the blade 60 is permitted to drop with the result that the heater is off, as is the lamp 66. The contacts 54, 56 do not engage and the contact 64 and tongue 60*b* do not engage. To the user, the absence of the light means that the iron is not ready for operating at a temperature suitable for synthetics.

When the iron has cooled sufficiently (FIG. 11), the bimetallic element 36 rises permitting the blade 50 to rise and raising the blade 60. Before the contacts 54 and 56 close, the contact 64 will engage the tongue 60*b* flashing on the light 66 and indicating that the iron is ready to use at the new low temperature.

Subsequently (FIG. 12), as the temperature drops further, the bimetallic element 36 will rise further permitting the blade 50 to raise so that contacts 54 and 56 engage, activating the heater H and shorting out the light 66. The flexure of the blade 60 at the points 60*a*′ and 60*c* absorb the further upward movement of the bimetallic element 36.

Subsequently (not shown), the iron will pick up heat with the activation of the heater H, driving the bimetallic element 36 downward to in turn lower blade 50 and disengage contacts 54, 56, deactivating the heater H and reactivating the lamp 66 as the contact 64 and tongue 60*b* stay engaged. This cycling is continued as long as the iron is maintained at the low setting.

It will thus be apparent that from a very minor modification of a conventional two-blade thermostat switch an iron may be provided with an effective ready light for indicating when the iron is at the desired temperature. It will be apparent that at the factory the setting of the light switch is accomplished by adjustment of the set-screw-type contact 64.

Variations of the arrangement described are possible, all within the scope of the invention which may be defined by the following claim language:

I claim:

1. In an electric pressing iron having a heater circuit, the iron having mounted on the top of its soleplate a temperature-sensitive switch comprising a pair of superposed, spaced aligned contact blades cantilever-mounted and extending in the same direction, the switch including an upper blade and a lower blade, the blades carrying aligned contact zones, a bimetallic element cantilever-mounted on the soleplate in heat exchange relation therewith and adapted to engage with its distal end the lower blade to move the distal end of said lower blade away from the upper blade in conditions of no-heat-demand to separate the contact zones, temperature control setting means on the iron including means to raise and lower the distal end of the upper blade, the heater circuit being operatively connected in series with the switch, the improvement of a ready light circuit including a third blade mounted cantilever-fashion and disposed between and generally aligned with the other blades, the upper blade and third blade having aligned contact points, the bimetallic element adapted in conditions approaching heat-demand to cause upward movement of the distal end of the third blade to adjacent the upper blade to close the contact points, the ready light and the contact points being operatively connected in series and across the contact zones of the upper and lower blades.

2. In an electric pressing iron as claimed in claim 1, the improvement wherein one of said contact points is an adjustable set-screw-type contact.

3. In an electric pressing iron as claimed in claim 2, the improvement wherein the other of said contact points is a tongue struck upward from its blade.

4. In an electric pressing iron as claimed in claim 1, the improvement wherein at least some of the blades are stamped from sheetmetal and are channel-shaped in cross section.

5. In an electric pressing iron as claimed in claim 1, the improvement wherein the third blade is of resilient sheet-metal and is angled upward at a flexure point outward toward the distal end from the engagement with it of the distal end of the bimetallic element.

6. In an electric pressing iron as claimed in claim 5, the improvement wherein the contact point on the third blade is on an upstruck tongue toward the distal end from the flexure point.

7. An electric iron having a heater, temperature setting means, a first heater switch blade mounted at one end on the iron soleplate, means connecting the setting means and the other end of the blade to lower the distal end of the blade to lower levels corresponding to higher temperature settings, a second heater switch blade beneath and in alignment with the first blade and having one end mounted under the said one end of the first blade, a bimetallic strip mounted at one end on the soleplate and extending toward and engaging the top of the other end of the second blade, the said other end of the second blade being biased upwardly, a first set of aligned contacts on the first and second blades respectively and circuit means connecting the first set of contacts in series with the heater and a power source, a third blade having an end mounted between the said one ends of the first and second blades and having its other end biased downward and resting normally on the other end of the bimetallic element, an indicator lamp, a second set of aligned contacts on the first and third blades respectively and second circuit means connecting the second set of aligned contacts with the lamp across the first set.

8. An electric pressing iron as claimed in claim 7 wherein one of the contacts of the second set of aligned contacts is adjustable toward and away from the other contact of the second set.

9. An electric pressing iron as claimed in claim 7 wherein the third blade has a cut-out in alignment with the first set of contacts.

10. An electric pressing iron as claimed in claim 7 wherein the said other end of the second blade presents a dog-leg away from the third leg.

11. An electric pressing iron as claimed in claim 7 wherein the contact on the third blade is on a tongue inclined toward the first blade.

12. In an electric pressing iron having a heater circuit, the iron having mounted on the top of its soleplate a temperature-sensitive switch comprising three superposed, spaced aligned contact blades cantilever-mounted and extending in the same direction, the switch including a first blade and a second blade carrying aligned contact points, a bimetallic element cantilever-mounted on the soleplate in heat exchange relation therewith and having its distal end adapted to move the distal end of said second blade away from the first blade in conditions of no-heat-demand to open the electrical connection through the contact points on the first and second blades, temperature control setting means on the iron including means to raise and lower the distal end of the first blade, the heater circuit being operatively connected in series with the first and second blades, a ready light circuit including a third blade disposed between and generally aligned with the other blades, the first blade and third blade having aligned contact points, the bimetallic element adapted at temperature in a range below but proximate heat-demand temperature to cause engagement of the contact points of the third blade and the first blade, means connecting the ready light and the third blade operatively in series to the second blade.

13. In an electric pressing iron having a heater, the iron having mounted adjacent its soleplate a temperature-sensitive switch comprising three superposed, spaced aligned contact blades cantilever-mounted and extending in the same direction, the switch including a first blade and a second blade carrying aligned contact points, a bimetallic element cantilever-mounted adjacent the soleplate in heat exchange relation therewith and having its distal end adapted to move the distal end of said second blade away from the first blade in conditions of no-heat-demand to open the electrical connection through the contact points on the first and second blades, temperature control setting means on the iron including means to move the distal end of the first blade toward and away from the second blade, the heater being operatively connected in series with the first and second blades and to supply means, a ready light circuit including a third blade disposed between and generally aligned with the other blades, the first blade and third blade having aligned contact points, the bimetallic element adapted at temperature in a range below but proximate heat-demand temperature to cause engagement of the contact points of the third blade and the first blade, means connecting the ready light and the third blade operatively in series to the second blade.

* * * * *